US007597107B2

(12) United States Patent
Imai et al.

(10) Patent No.: US 7,597,107 B2
(45) Date of Patent: Oct. 6, 2009

(54) HAIR STYLING APPLIANCE

(75) Inventors: Takeshi Imai, Osaka (JP); Sakae Uchinashi, Moriguchi (JP)

(73) Assignee: Matsushita Electric Works, Ltd., Kadoma-shi (JP)

( * ) Notice: Subject to any disclaimer, the term of this patent is extended or adjusted under 35 U.S.C. 154(b) by 345 days.

(21) Appl. No.: 11/442,442

(22) Filed: May 30, 2006

(65) Prior Publication Data

US 2006/0272669 A1 Dec. 7, 2006

(30) Foreign Application Priority Data

Jun. 1, 2005 (JP) ..... 2005-161980

(51) Int. Cl.
*A45D 7/02* (2006.01)
*A45D 1/00* (2006.01)

(52) U.S. Cl. ..... 132/212; 132/224

(58) Field of Classification Search ..... 132/212, 132/223–225, 229; 219/225–229; 433/119
See application file for complete search history.

(56) References Cited

U.S. PATENT DOCUMENTS

2004/0010222 A1 1/2004 Nunomura et al. ..... 604/22

FOREIGN PATENT DOCUMENTS

| | | |
|---|---|---|
| JP | 08-256818 | 10/1996 |
| JP | 2000-41725 | 2/2000 |
| JP | 2002-282788 | 10/2002 |

OTHER PUBLICATIONS

The extended European Search Report dated Sep. 14, 2006, 3 pages.

*Primary Examiner*—Robyn Doan
*Assistant Examiner*—Rachel R Steitz
(74) *Attorney, Agent, or Firm*—Edwards Angell Palmer & Dodge LLP

(57) ABSTRACT

A hair styling appliance is provided in order to prevent hair between a vibrating portion and a backing portion from spreading widely by ultrasonic vibration of the vibrating portion. The vibrating portion comprises a vibrator and an ultrasonic vibration horn. The horn has a contact end brought into contact with the hair and a mounting end on which the vibrator is mounted, and amplifies and transmits the ultrasonic vibration of the vibrator mounted on the mounting end to the contact end. The horn is formed so that amplitude of the ultrasonic vibration in both sides of the center of the contact end is larger than that in the center.

3 Claims, 7 Drawing Sheets

HAIR STYLING APPLIANCE

TECHNICAL FIELD

The invention relates to hair styling appliances that utilize ultrasonic vibration for hair styling.

BACKGROUND ART

As shown in FIGS. 1 and 2, a prior art appliance 1 described in Japanese Laid-open Patent Publication No. 2002-282788 is known as the above hair styling appliance. As shown in FIGS. 1-3, the appliance 1 comprises a vibrating portion 3 and a backing portion 7 between which hair 9 is placed, and the portions 3 and 7 are closed and separated (opened) by a user. The vibrating portion 3 comprises a vibrator 4 that generates ultrasonic vibration, and an ultrasonic vibration horn 5 that has a contact end 5*a* brought into contact with the hair 9 and a mounting end 5*b* on which the vibrator 4 is mounted. The horn 5 amplifies and transmits the ultrasonic vibration of the vibrator 4 mounted on the mounting end 5*b* to the contact end 5*a*. The ultrasonic vibration in the contact end 5*a* is utilized for hair styling (care for changing hair form).

The contact end 5*a* is formed into a line or rectangle shape, and the hair 9 is orthogonalized with respect to the longitudinal direction A1 of the contact end 5*a*. In a prior art appliance described in the "BACKGROUND ART" of the above Patent Publication, as shown in FIG. 4, amplitude B1 of the ultrasonic vibration in the center of the longitudinal direction A2 of its contact end 5*a*' is larger than amplitude B2 in both sides of the center. On the other hand, in the appliance 1, as shown in FIGS. 5 and 6, amplitude B0 of the ultrasonic vibration in the contact end 5*a* is equal over each part of the contact end 5*a*. However, in these cases, as shown in FIG. 7, the hair 9 between the portions 3 and 7 spreads widely by the ultrasonic vibration, which causes unsettled hair styling effect, increased styling time, increased power consumption and so on.

DISCLOSURE OF THE INVENTION

It is therefore an object of the present invention to prevent hair between a vibrating portion and a backing portion from spreading widely by ultrasonic vibration of the vibrating portion.

A hair styling appliance of the present invention comprises a vibrating portion and a backing portion between which hair is placed, and the portions are closed and separated. The vibrating portion comprises a vibrator that generates ultrasonic vibration, and an ultrasonic vibration horn that has a contact end brought into contact with the hair and a mounting end on which the vibrator is mounted. The contact end and the mounting end are located at opposite sides of the horn. The horn amplifies and transmits the ultrasonic vibration of the vibrator mounted on the mounting end to the contact end. The horn is also formed so that amplitude of the ultrasonic vibration in both sides of the center of the contact end is larger than that in the center. According to this configuration, it is possible to prevent hair between the portions from spreading widely by the ultrasonic vibration of the vibrating portion.

The horn may be formed so that vibration direction of the ultrasonic vibration in each of the both sides inclines with respect to the contact end to approach each other. According to this configuration, it is possible to further prevent the hair from spreading widely.

At least one of the vibrating portion side and the backing portion side may be provided with presser member. According to this configuration, it is possible to further prevent the hair between the portions from spreading widely by the ultrasonic vibration of the vibrating portion.

BRIEF DESCRIPTION OF THE DRAWINGS

Preferred embodiments of the invention will now be described in further details. Other features and advantages of the present invention will become better understood with regard to the following detailed description and accompanying drawings where.

BEST MODE FOR CARRYING OUT THE INVENTION

Figure 1:
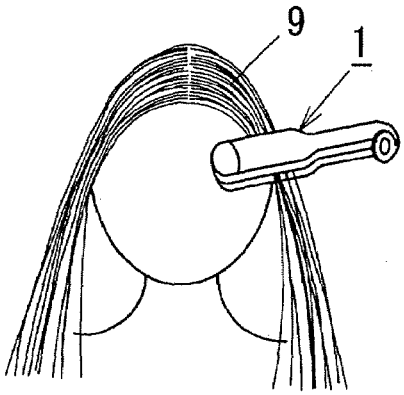
FIG. 1 PRIOR ART
FIG. 1 illustrates usage of a prior art appliance.
Figure 2:
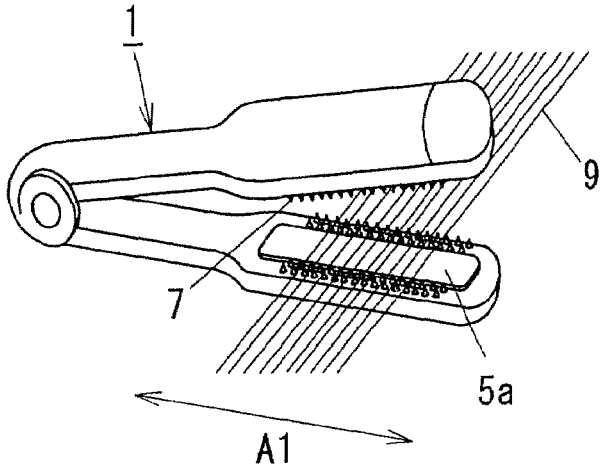
FIG. 2 PRIOR ART
FIG. 2 is a perspective view of the appliance of FIG. 1.
Figure 3:
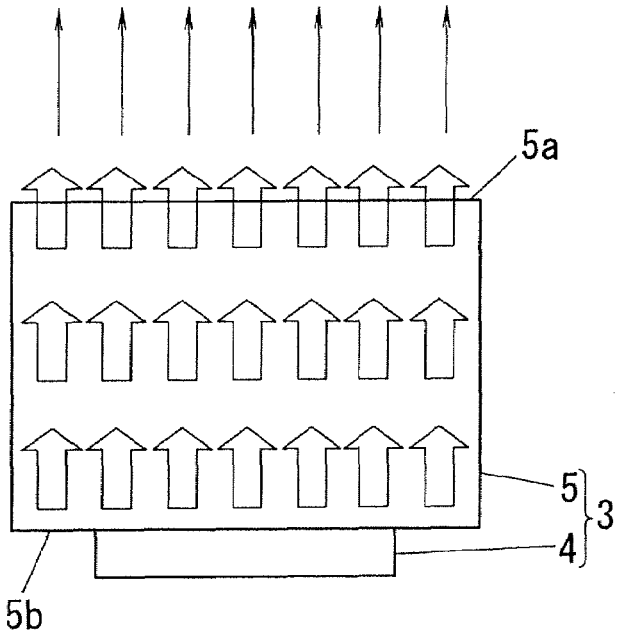
FIG. 3 PRIOR ART
FIG. 3 is a schematic diagram of a vibrating portion in the appliance of FIG. 1.
Figure 4:
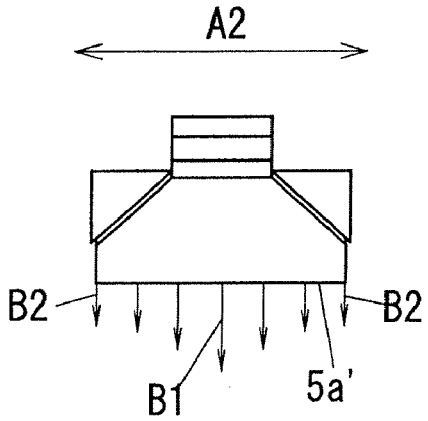
FIG. 4 PRIOR ART
FIG. 4 illustrates ultrasonic vibration amplitude of a vibrating portion in another prior art appliance.
Figure 5:
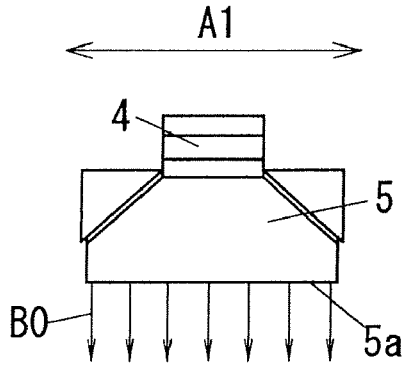
FIG. 5 PRIOR ART
FIG. 5 illustrates ultrasonic vibration amplitude of the vibrating portion in the appliance of FIG. 1.
Figure 6:
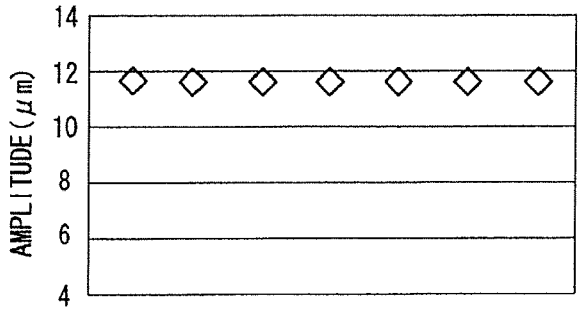
FIG. 6 PRIOR ART
FIG. 6 is a characteristic graph of the ultrasonic vibration amplitude of the vibrating portion in the appliance of FIG. 1.
Figure 7:
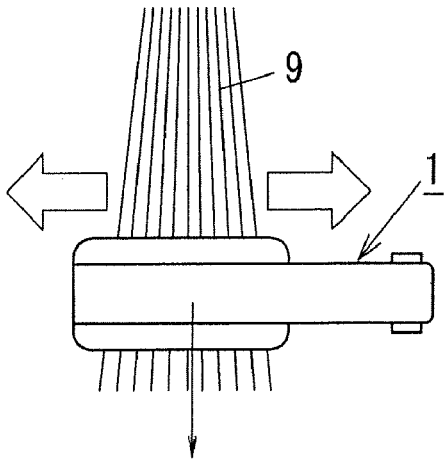
FIG. 7 PRIOR ART
FIG. 7 illustrates spread of hair by the appliance of FIG. 1.
Figure 8:
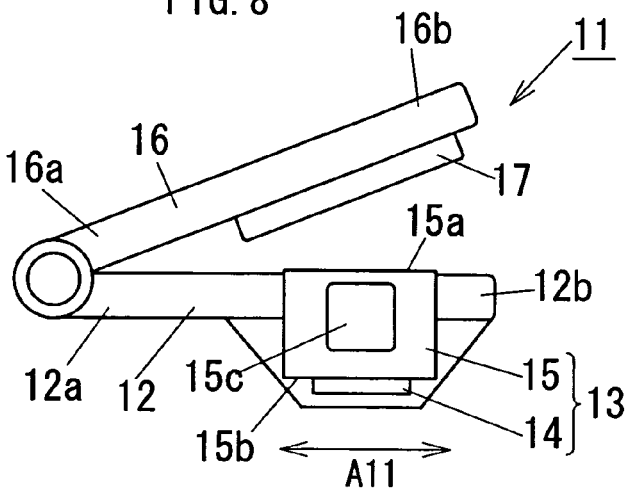
FIG. 8 is a schematic diagram of a first embodiment according to the present invention.

FIG. 8 shows a first embodiment, i.e., a hair styling appliance 11 according to the present invention. The appliance 11 comprises a first arm 12 formed into a bar or plate shape that is long in size, as well as a second arm 16 formed into a bar or plate shape that is long in size. The arm 12 is divided into a handle end 12*a* and a styling end 12*b*, and the arm 16 is also divided into a handle end 16*a* and a styling end 16*b*. Tips of the handle ends 12*a* and 16*a* of the arms 12 and 16 are fixed through a hinge so that the arms 12 and 16 are pivotable about the tips.

The styling end 12*b* of the arm 12 is provided with a vibrating portion 13 constructed with a vibrator 14 and an ultrasonic vibration horn 15, while the styling end 16*b* of the arm 16 is provided with a backing portion 17 such as, for example, a plate or the like. Namely, the appliance 11 comprises the vibrating portion 13 and the backing portion 17 between which hair is placed, and the portions 13 and 17 are closed and separated through the handle end 12*a* and 16*a* squeezed and relaxed by a user.

The vibrator 14 is configured to generate ultrasonic vibration. For example, the vibrator 14 has a drive source such as a magnetostriction element or piezoelectric vibrator constructed with piezoelectric material located between electrodes (e.g., conductive metal sheets such as nickel or beryllium copper), and converts electric vibration into mechanical vibration.

The horn 15 has a contact end 15*a* brought into contact with the hair and a mounting end 15*b* on which the vibrator 14 is mounted. The contact end 15*a* is formed into a line or long and narrow rectangle shape. The contact end 15*a* and the mounting end 15*b* are located at opposite sides of the horn 15. The horn 15 is made of, for example, metal, and amplifies and transmits the ultrasonic vibration of the vibrator 14 mounted on the mounting end 15*b* to the contact end 15*a*.

Figure 9:
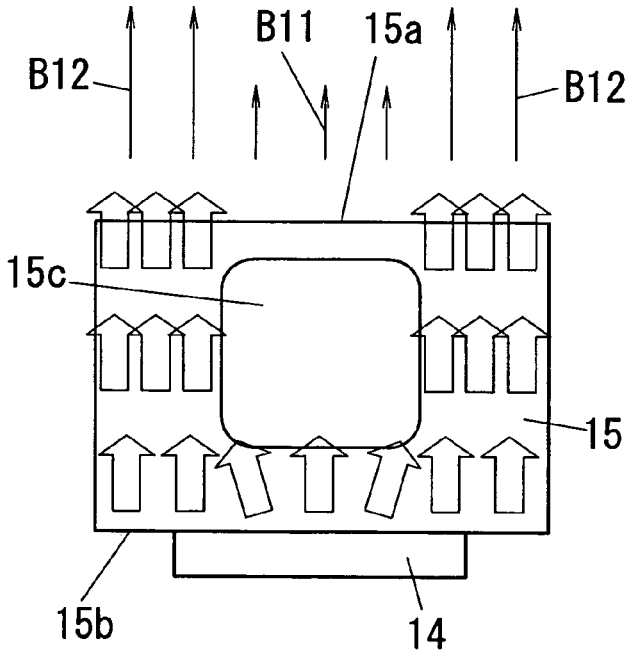
FIG. 9 is a schematic diagram of a vibrating portion in the first embodiment.
Figure 10:
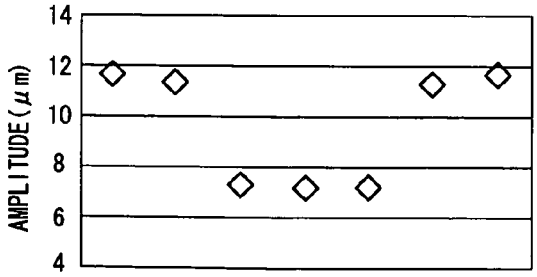
FIG. 10 is a characteristic graph of the ultrasonic vibration amplitude of the vibrating portion in the first embodiment.

As shown in FIGS. 9 and 10, the horn 15 is also formed so that amplitude B12 of a part of the ultrasonic vibration in both sides of the center in the longitudinal direction A11 of the contact end 15*a* is larger than amplitude B11 of the remaining part of the ultrasonic vibration in the center. The horn 15 of this embodiment is provided with an square or rectangle shaped opening (through hole) 15*c* having an axis orthogonalized with respect to the longitudinal direction A11.

Figure 11:
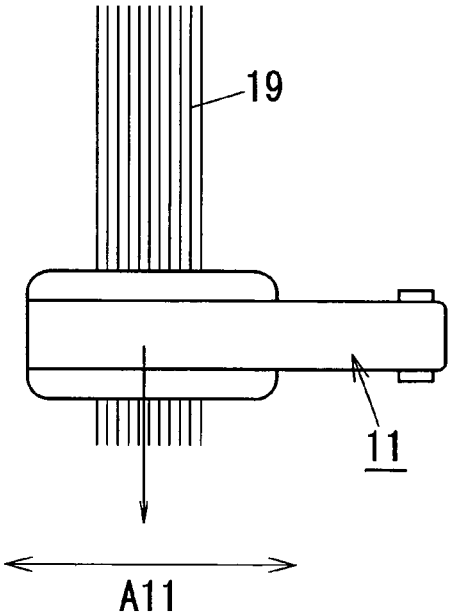
FIG. 11 illustrates spread of hair by the first embodiment.

The usage of the appliance 11 is the same as prior art appliances. Namely, hair is placed between the vibrating portion 13 and the backing portion 17 with the hair orthogonalized against the longitudinal direction A11 of the contact end 15*a*. The handle ends 12*a* and 16*a* are then squeezed by a user, and the vibrating portion 13 and the backing portion 17 are closed in a state that the hair 19 is placed between the portions 13 and 17. As shown in FIG. 11, the appliance 11 is then slid from near the root of the hair 19 to the end by the user.

In this case, using the prior art appliance 1 gives a user widely spread hair, but according to the appliance 11, it is possible to prevent hair 19 between the portions 13 and 17 from spreading widely by the ultrasonic vibration of the portion 13. In the appliance 1, since amplitude B0 of the ultrasonic vibration in the contact end 5*a* is equal over each part of the contact end 5*a*, the hair 9 is able to move along the contact end 5*a*, which causes unsettled hair styling effect and so on. On the other hand, in the appliance 11, since the horn 15 is provided with the opening 15*c*, the amplitude B11 of the ultrasonic vibration from the opening 15*c* is smaller than the amplitude B12 of the ultrasonic vibration from both sides of the opening 15*c*, so that it is possible to prevent the hair 19 from spreading widely.

Hair styling with the appliance 11 is also gentle for hair. Hair styling requires drying hair in order to evaporate moisture inside the hair to rearrange hydrogen bonding among each Keratin. For example, conventional hair straighteners are provided with plates that becomes extremely high temperature (e.g., 130° C.) in order to evaporate moisture inside hair, but the high temperature causes denatuation of protein and scald. According to the appliance 11, it is possible to atomize moisture inside hair to evaporate the moisture by ultrasonic vibration, even under room temperature.

Figure 12:
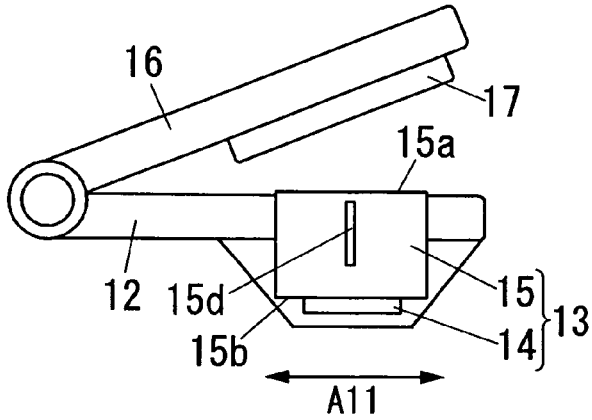
FIG. 12 is a schematic diagram of a modified embodiment.
Figure 13:
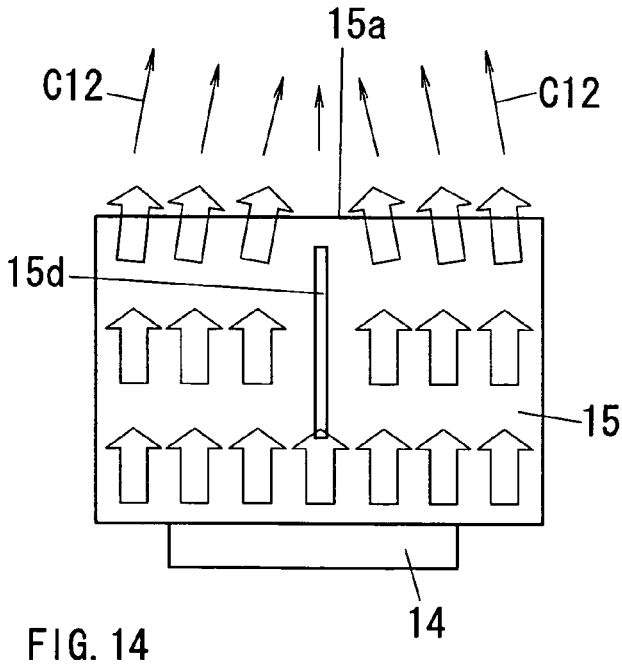
FIG. 13 is a schematic diagram of a vibrating portion in the modified embodiment.
Figure 14:
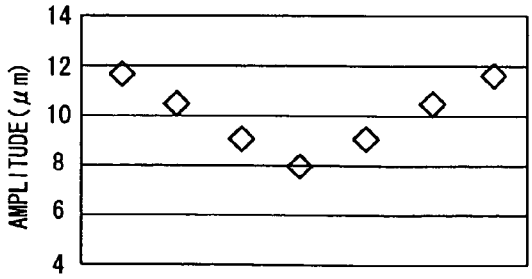
FIG. 14 is a characteristic graph of the ultrasonic vibration amplitude of the vibrating portion in the modified embodiment.

In a modified embodiment, as shown in FIGS. 12-14, the horn 15 is formed so that vibration direction C12 of the ultrasonic vibration in each of the both sides of the contact end 15*a* inclines with respect to the contact end 15*a* to approach each other. For example, a slit 15*d* extending from the mounting end side to the contact end side is formed in stead of the opening 15*c*. Also, the amplitude of the ultrasonic vibration from the slit 15*d* is smaller than the amplitude of the ultrasonic vibration from both sides of the slit 15*d*. According to this configuration, it is possible to further prevent the hair from spreading widely.

Figure 15:
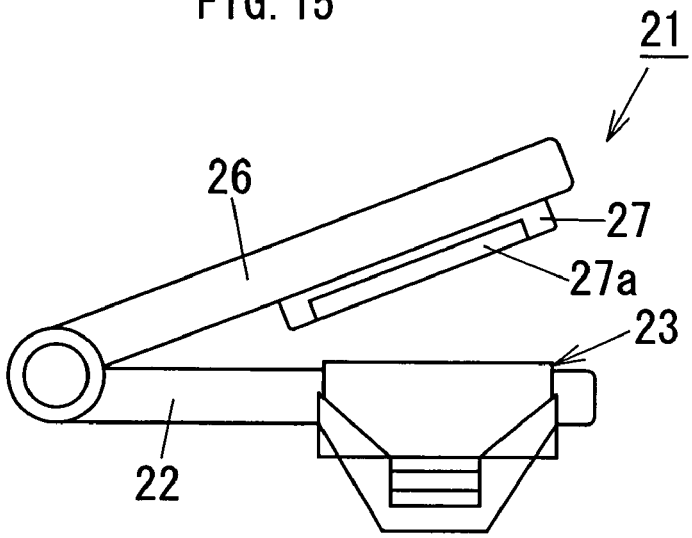
FIG. 15 is a schematic diagram of a second embodiment according to the present invention.

FIG. 15 shows a second embodiment, i.e., a hair styling appliance 21 according to the present invention. The appliance 21 comprises a first arm 22, a vibrating portion 23, a second arm 26 and a backing portion 27 in almost the same way as those of the appliance of FIG. 8 or 12, and is characterized by a heating element mounted at least one of the vibrating portion 23 and the backing portion 27.

Figure 16:
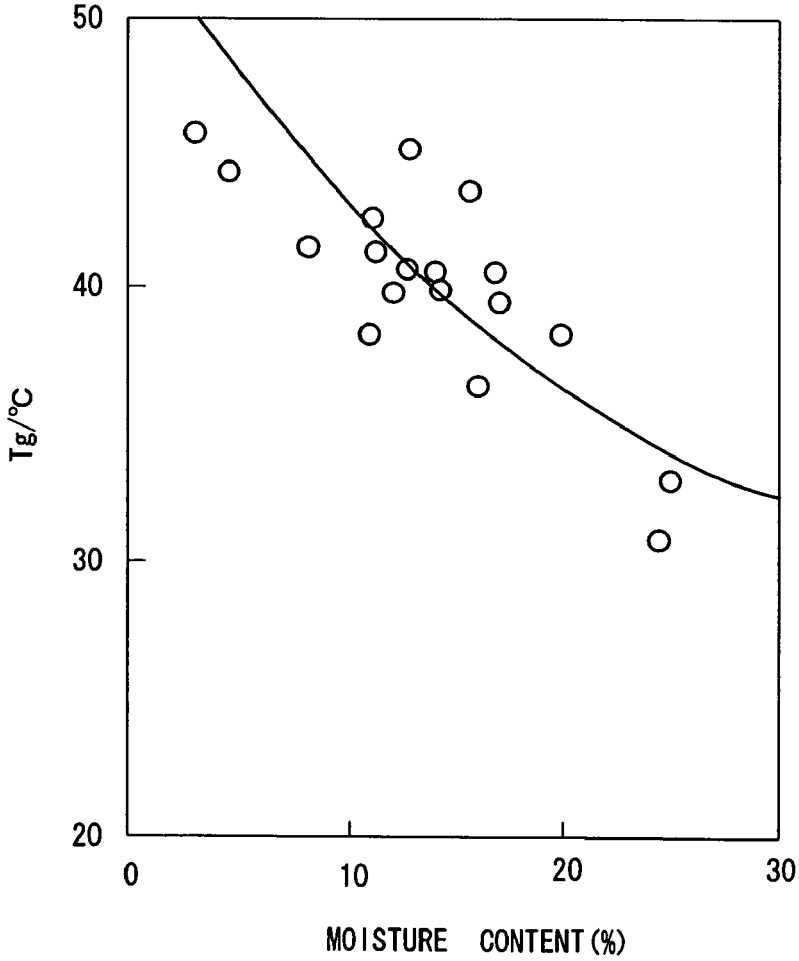
FIG. 16 is a graph showing relationship between glass transition temperature and moisture content.

As shown in FIG. 15, the heating element designated by 27*a* is a plate mounted on the backing portion 27, and is constructed of but not limited to an element that generates heat by Joule heating, such as Peltier device or the like. The surface temperature of the heating element 27*a* is set to reach 50-90° C. Setting the lower limit of the surface temperature to 50° C. can keep temperature of hair more than glass transition temperature by which form of the hair becomes easy to change. FIG. 16 shows relationship between glass transition temperature (Tg/° C.) and moisture content of hair. In FIG. 16, white circles are measurement values and the curve is obtained from the measurement values. By ultrasonic vibration, moisture content of hair becomes about 10%, and in this case, glass transition temperature becomes about 40° C. On account of this, the above lower limit is set to about 50° C. including a margin. The upper limit of the surface temperature is set to about 90° C. in order to avoid denatuation of protein and scald. According to this configuration, it is possible to improve hair styling effect.

Figure 17A:
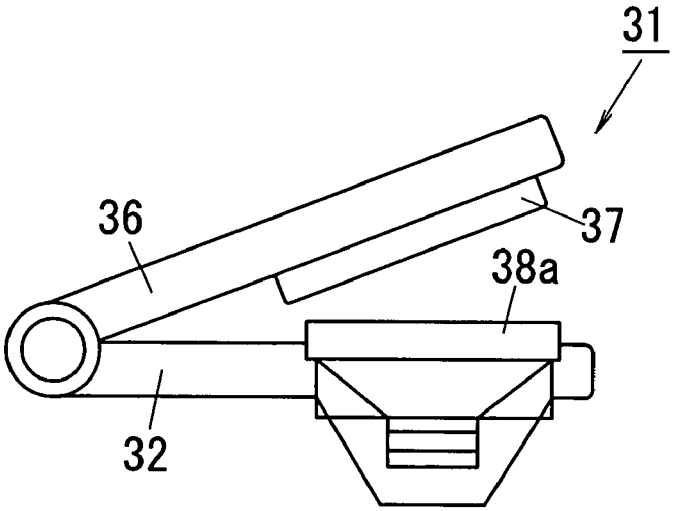
FIG. 17A is a schematic diagram of a third embodiment according to the present invention.
Figure 17B:
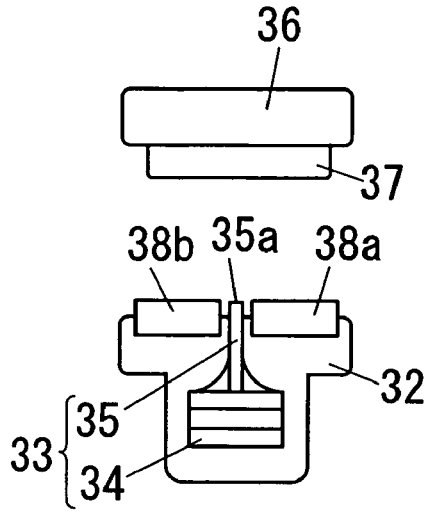
FIG. 17B is a schematic diagram as seen from pivotable side of the third embodiment.
Figure 18:
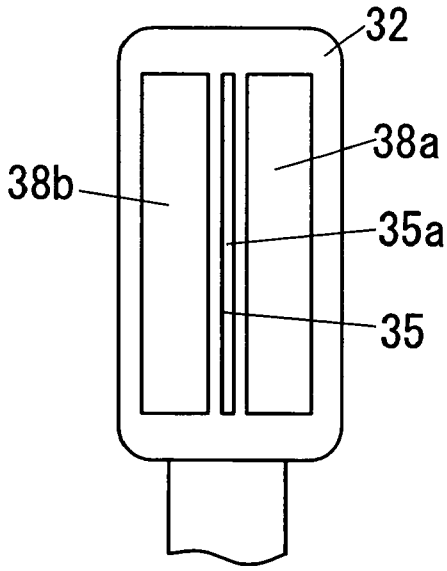
FIG. 18 is a schematic diagram of a backing portion side in the third embodiment.

FIGS. 17A, 17B and 18 show a third embodiment, i.e., a hair styling appliance 31 according to the present invention. The appliance 31 comprises a first arm 32, a vibrating portion 33 (a vibrator 34 and a horn 35), a second arm 36 and a backing portion 37 in almost the same way as those of the appliance of FIG. 8, 12 or 15, and is characterized by presser member provided for at least one of the vibrating portion side and the backing portion side.

Figure 19A:
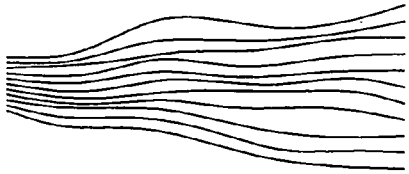
FIG. 19A illustrates hair before hair styling.
Figure 19C:
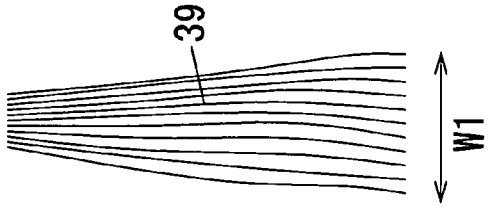
FIG. 19C illustrates hair after hair styling by the appliance of FIG. 19B.
Figure 19E:
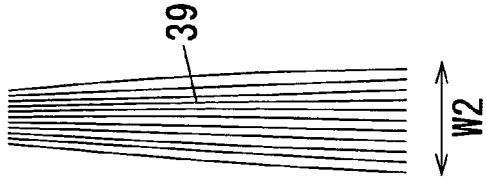
FIG. 19E illustrates hair after hair styling by the appliance of FIG. 19D.
Figure 19G:
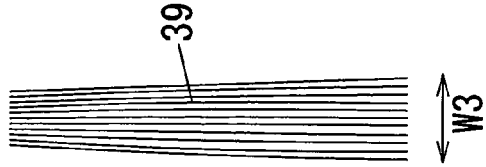
FIG. 19G illustrates hair after hair styling by the third embodiment.
Figure 19B:
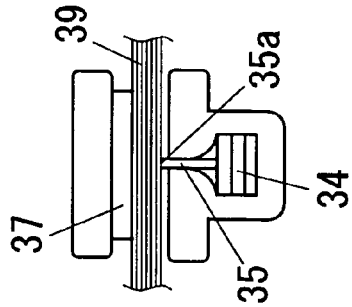
FIG. 19B is a schematic diagram of an appliance with no presser member.
Figure 19D:
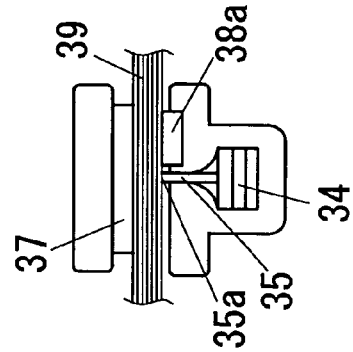
FIG. 19D is a schematic diagram of an appliance with one presser member.
Figure 19F:
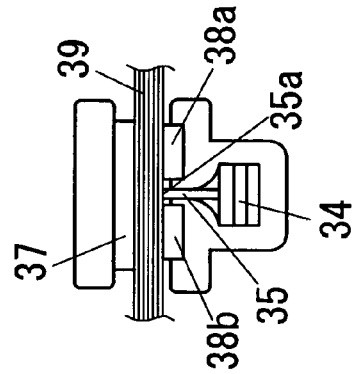
FIG. 19F is a schematic diagram of the third embodiment.

In this embodiment, a pair of presser members designated by 38*a* and 38*b* are arranged at both sides of a contact end 35*a* of a horn 35 in the vibrating portion side, and prevent hair from spreading widely. FIG. 19A shows hair before hair styling. FIG. 19C shows hair 39 after hair styling by an appliance with no presser member as shown in FIG. 19B. FIG. 19E shows hair 39 after hair styling by an appliance with one presser member 38*a* as shown in FIG. 19D. FIG. 19G shows hair 39 after hair styling by the appliance 31 with the presser members 38*a* and 38*b* as shown in FIG. 19F. The spread width W2 of the hair 39 of FIG. 19E is more narrow than the spread width W1 of the hair 39 of FIG. 19C, and also the spread width W3 of the hair 39 of FIG. 19G is more narrow than the spread width W2. From these figures, it is understood that it is possible to prevent hair from spreading widely through at least of the presser members 38*a* and 38*b*.

Although the present invention has been described with reference to certain preferred embodiments, numerous modifications and variations can be made by those skilled in the art without departing from the true spirit and scope of this invention.

For example, the present invention is applicable to things like hair or things such as fiber.

The invention claimed is:

1. A hair styling appliance, comprising a first arm and a second arm, wherein the first arm and second arm are joined by a hinge, the first arm is divided into a first handle end and a styling end, the second arm is divided into a second handle end and a backing portion, the styling end is provided with a vibrating portion, wherein the vibrating portion comes into contact with the backing portion between which hair is placed, the vibrating portion and backing portion being closed and separated, the vibrating portion comprises:

a vibrator that generates ultrasonic vibration; and an ultrasonic vibration horn that has a contact end capable of being brought into contact with the hair and a mounting end on which said vibrator is mounted, said contacted end and said mounting end being located at opposite sides of the horn, said horn amplifying and transmitting the ultrasonic vibration of the vibrator mounted on the mounting end to the contact end, said horn being formed so that amplitude of the ultrasonic vibration in both sides of the center of the contact end is larger than that in the center, wherein said horn is formed so that vibration direction of the ultrasonic vibration in each of said both sides inclines with respect to said contact end to approach each other.

2. The hair styling appliance of claim 1, wherein at least one of said vibrating portion side and said backing portion side is provided with presser member.

3. The hair styling appliance of claim 1, wherein said contact end is formed into a line or long narrow rectangular shape, wherein said horn is formed with a slit extending from the mounting end side to the contact end side so that vibration direction of the ultrasonic vibration in each of said both sides of the contact end inclines with respect to the contact end to approach each other.

* * * * *